US010760384B2

(12) United States Patent
Schmidt et al.

(10) Patent No.: US 10,760,384 B2
(45) Date of Patent: Sep. 1, 2020

(54) METHOD OF CREATING AND FINISHING PERFORATIONS IN A HYDROCARBON WELL

(71) Applicant: THE GASGUN, LLC, Clackamas, OR (US)

(72) Inventors: Adam C. Schmidt, Happy Valley, OR (US); Jaia D. Schmidt, Happy Valley, OR (US); Richard A. Schmidt, West Linn, OR (US)

(73) Assignee: The Gasgun, LLC, Clackamas, OR (US)

( * ) Notice: Subject to any disclaimer, the term of this patent is extended or adjusted under 35 U.S.C. 154(b) by 66 days.

(21) Appl. No.: 16/036,920

(22) Filed: Jul. 16, 2018

(65) Prior Publication Data

US 2018/0320491 A1 Nov. 8, 2018

Related U.S. Application Data

(63) Continuation of application No. 14/585,956, filed on Dec. 30, 2014, now Pat. No. 10,024,145.

(51) Int. Cl.

| | |
|---|---|
| ***E21B 43/117*** | (2006.01) |
| ***E21B 43/118*** | (2006.01) |
| ***F42D 1/04*** | (2006.01) |
| ***F42D 1/045*** | (2006.01) |
| ***F42B 3/22*** | (2006.01) |

(52) U.S. Cl.
CPC ..... *E21B 43/117* (2013.01)

(58) Field of Classification Search
CPC ..... E21B 43/117; E21B 43/118
USPC ..... 102/331, 314, 317, 320
See application file for complete search history.

(56) References Cited

U.S. PATENT DOCUMENTS

| | | | | |
|---|---|---|---|---|
| 3,422,760 | A | 1/1969 | Mohaupt | |
| 3,630,284 | A * | 12/1971 | Fast | E21B 23/04 166/299 |
| 4,039,030 | A | 8/1977 | Godfrey et al. | |
| 4,081,031 | A | 3/1978 | Mohaupt | |
| 4,386,569 | A | 6/1983 | Deas | |
| 4,391,337 | A | 7/1983 | Ford et al. | |
| 4,491,185 | A | 1/1985 | McClure | |
| 4,548,252 | A | 10/1985 | Stowe et al. | |
| 4,633,951 | A | 1/1987 | Hill et al. | |
| 4,673,039 | A | 6/1987 | Mohaupt | |
| 4,798,244 | A | 1/1989 | Trost | |
| 5,212,342 | A * | 5/1993 | Eches | F42B 5/181 102/317 |
| 5,295,545 | A | 3/1994 | Passamaneck | |
| 5,690,171 | A | 11/1997 | Winch et al. | |
| 6,082,450 | A | 7/2000 | Snider et al. | |

(Continued)

*Primary Examiner* — D. Andrews
*Assistant Examiner* — Manuel C Portocarrero
(74) *Attorney, Agent, or Firm* — Vorys, Sater, Seymour and Pease LLP

(57) ABSTRACT

A method of creating and finishing perforations in a hydrocarbon well having a well wall that includes causing a high velocity jet of a material to shoot into the well wall, thereby creating a perforation in the well wall. The method further includes introducing a gas blast into the perforation, for a blast time duration, the gas blast creating an increasing pressure at the perforation until a maximum pressure is reached; and allowing the pressure of the gas blast to undergo a period of rapid decline to a level of less than 50% of the maximum pressure.

20 Claims, 6 Drawing Sheets

(56) References Cited

U.S. PATENT DOCUMENTS

| | | | | |
|---|---|---|---|---|
| 6,354,219 | B1 | 3/2002 | Pratt et al. | |
| 6,991,044 | B2 | 1/2006 | Zhange et al. | |
| 7,228,907 | B2 | 6/2007 | Schmidt et al. | |
| 7,393,423 | B2 * | 7/2008 | Liu | C06B 33/00 149/108.2 |
| 7,431,075 | B2 | 10/2008 | Brooks et al. | |
| 7,621,332 | B2 | 11/2009 | Haney et al. | |
| 7,913,761 | B2 | 3/2011 | Pratt et al. | |
| 8,033,332 | B2 | 10/2011 | Haney et al. | |
| 8,336,437 | B2 | 12/2012 | Barlow et al. | |
| 8,342,094 | B2 | 1/2013 | Marya et al. | |
| 8,381,652 | B2 | 2/2013 | Glenn | |
| 10,024,145 | B1 * | 7/2018 | Schmidt | E21B 43/117 |
| 2003/0155112 | A1 | 8/2003 | Tiernan et al. | |
| 2003/0155125 | A1 | 8/2003 | Tiernan et al. | |
| 2005/0109509 | A1 | 5/2005 | Snider et al. | |
| 2006/0185898 | A1 | 8/2006 | Seekford | |
| 2007/0084604 | A1 | 4/2007 | Haney et al. | |

* cited by examiner

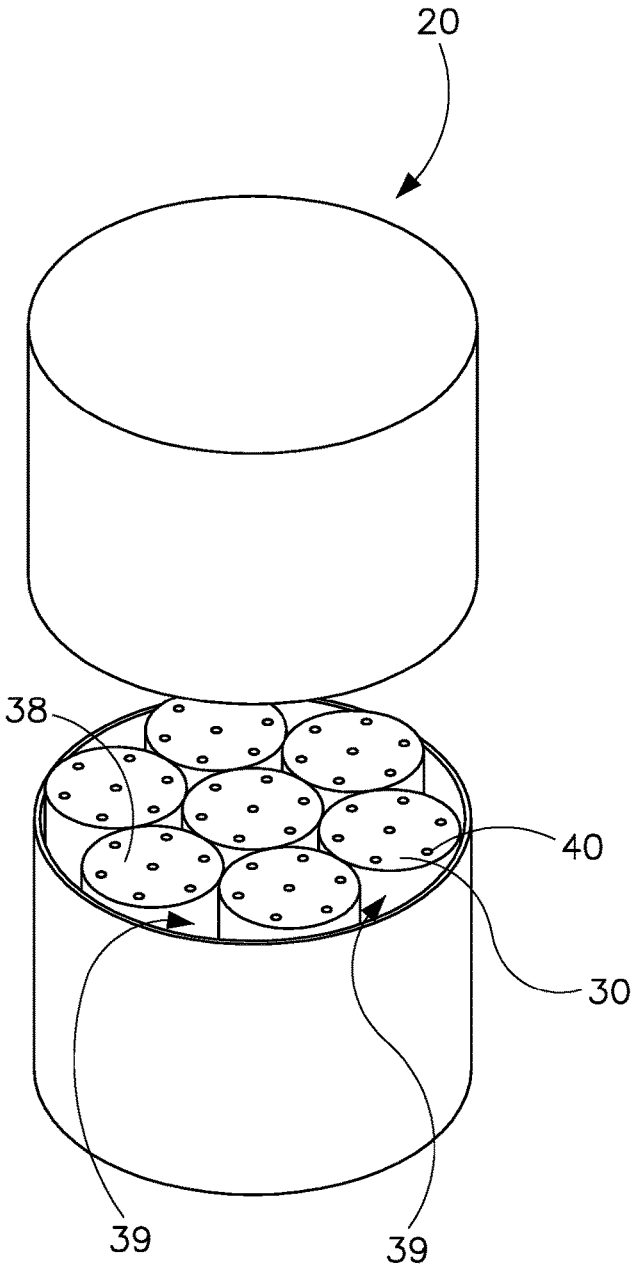
FIG. 7
FIG. 8
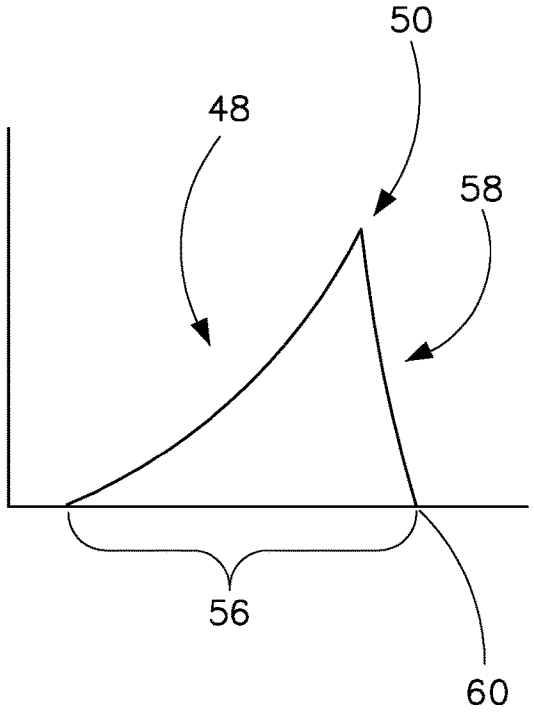

METHOD OF CREATING AND FINISHING PERFORATIONS IN A HYDROCARBON WELL

CROSS-REFERENCE TO RELATED APPLICATIONS

This application is a continuation of U.S. Non-Provisional patent application Ser. No. 14/585,956, filed on Dec. 30, 2014, and set to issue as U.S. patent Ser. No. 10/024,145 on Jul. 17, 2018, the disclosure of which being incorporated herein by reference in its entirety for all purposes.

BACKGROUND

Field of the Disclosure

Embodiments herein pertain to creating and finishing perforations in a hydrocarbon well.

Background of the Disclosure

A hydrocarbon well (oil or gas) is typically finished using a device known as a perforating gun. This device includes a steel tube containing a set of devices, typically referred to as "shaped charges" each of which includes a charge of high explosive and a small amount of copper. The tube is lowered into the well, and the high explosive charges are detonated, fragmenting the copper and accelerating the resultant copper particles to a speed on the order of 30 mach, so that it blasts through the wall of the steel tube, through any steel casing forming the wall of the well, and perforates the surrounding rock, thereby permitting oil or gas or both to flow into the well.

Unfortunately, the resultant perforation has some characteristics that inhibit the flow of liquid or gas into the perforation from the surrounding rock. As the copper particles push into the rock it pushes the rock immediately in its path rearward and to the side, and also heats this rock, resulting in perforation surfaces that are less permeable to the flow of liquids and gasses than would otherwise be the case.

SUMMARY

Embodiments herein pertain to a method of creating and finishing perforations in a hydrocarbon well having a well wall that may include one or more of: shooting a high velocity jet of metal particles into the well wall, thereby creating a perforation in the well wall; pushing a gas blast into the perforation, for a blast time duration, the gas blast creating an increasing pressure at the perforation, until a maximum is reached, the pressure of the gas then undergoing a period of rapid decline to a level of less than 50% of the maximum pressure.

In aspects, the period of rapid decline takes less than one-sixth of the blast time duration. The time pattern of speed and pressure of the gas blast may result in a higher maximum pressure at the perforation than would have happened had the maximum pressure been reached midway through the gas blast, thereby resulting in localized fracturing, emanating from the perforation. This may permit a greater flow of hydrocarbons into the perforation and from the perforation into the well.

The period of rapid decline may take less than one-tenth of the blast time duration. The gas blast may flow at an increasing speed, as the pressure increases.

Other embodiments herein pertain to a method of creating and finishing perforations in a hydrocarbon well having a well wall that may include one or more of: operating a perforation assembly to cause a high velocity jet of a material to shoot into the well wall, thereby creating a perforation in the well wall.

The perforation assembly may include: a tube having a tube wall; a plurality of shaped charges disposed within the tube and adapted to shoot the high velocity jet through the tube wall and into the well wall; a propellant also disposed within the tube, the propellant having a surface area; and a detonating cord operable to ignite the shaped charges and the propellant.

In aspects, the propellant may be configured to undergo a combustion until it is substantially consumed by the combustion. The propellant may initially combust slowly enough that the combustion of the propellant does not interfere with functioning of an at least one of any of the plurality of shaped charges.

The method may further include introducing a gas blast into the perforation for a blast time duration, the gas blast eventually reaching a maximum pressure. The method may include allowing a pressure of the gas blast to undergo a period of rapid decline to a level of less than 50% of the maximum pressure.

The period of rapid decline may take less than one-sixth of the blast time duration.

Still other embodiments herein pertain to a method of perforating a well wall that may include one or more of: providing a perforation creating-and-finishing assembly for use in a well having a well wall. The assembly may include: a tube having a tube wall; a plurality of shaped charges positioned within the tube; a propellant also positioned within the tube, the propellant having a surface area and being configured so as to combust at an increasing rate until substantially consumed; and a detonator disposed within the tube.

The method may include lowering the assembly into the well to a predetermined position. The method may include operating the assembly to ignite the detonator, thereby igniting the plurality of shaped charges and the propellant. The plurality of shaped charges may be configured to provide or facilitate the shooting of a high velocity jet of metal particles through the tube wall and into the well wall, thereby creating a perforation.

Yet still other embodiments of the disclosure pertain to a method of creating and finishing perforations in a hydrocarbon well having a well wall that may include one or more of: causing a high velocity jet of a material to shoot into the well wall, thereby creating a perforation in the well wall; introducing a gas blast into the perforation, for a blast time duration, the gas blast creating an increasing pressure at the perforation until a maximum pressure is reached; and allowing the pressure of the gas blast to undergo a period of rapid decline to a level of less than 50% of the maximum pressure.

In aspects, the period of rapid decline may take less than one-sixth of the blast time duration.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein:

FIG. 7 is an isometric view of a cylindrical carton filled with pieces of propellant.

FIG. 8 is a graph of combustion rate over time of the propellant in the device of FIGS. 1-3 and 5.

Exemplary embodiments are illustrated in referenced drawings. It is intended that the embodiments and figures disclosed herein are to be considered illustrative rather than restrictive.

DETAILED DESCRIPTION

Figure 1:
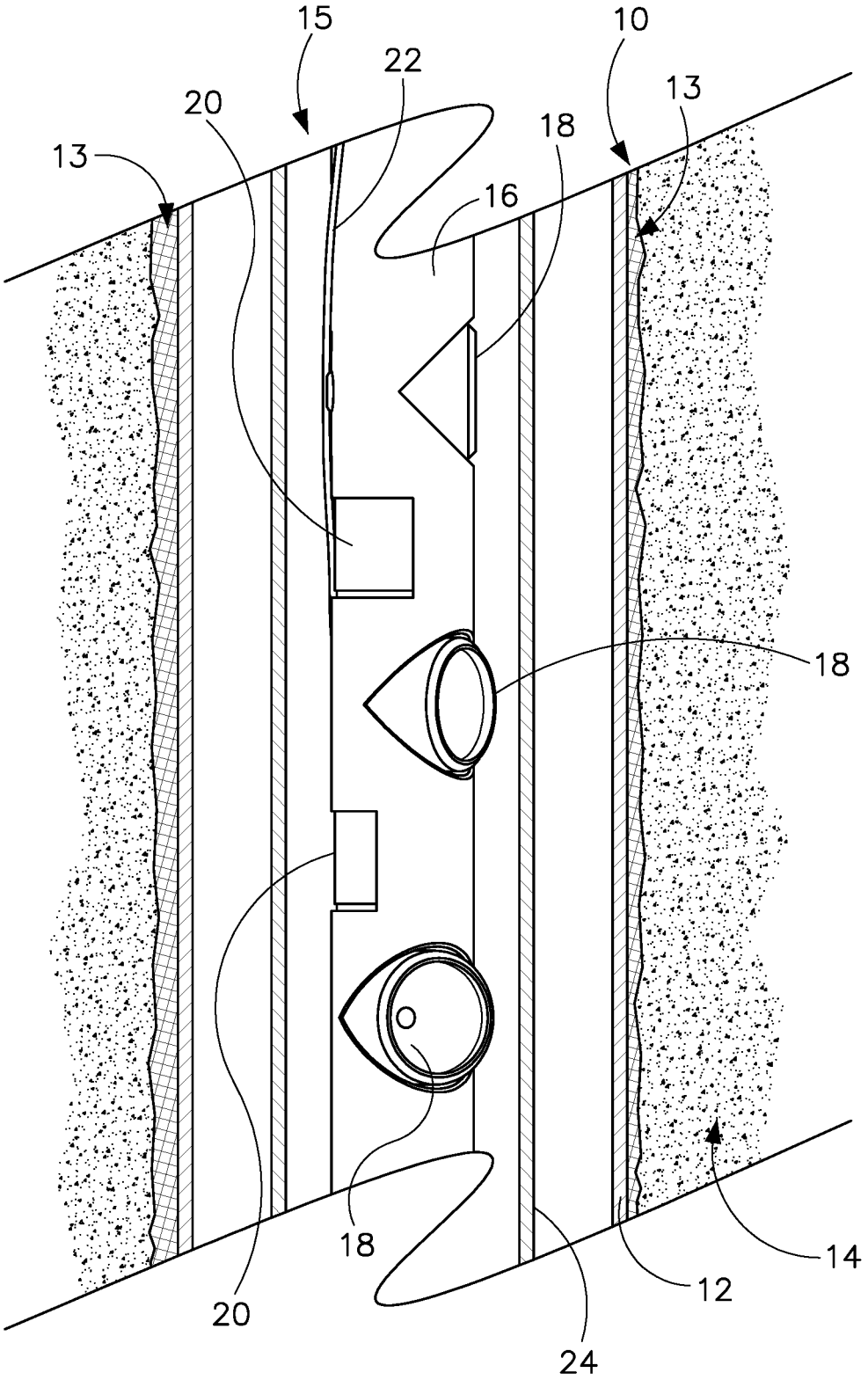
FIG. 1 is a sectional view 5 of a portion of a hydrocarbon well having a perforation creating and finishing device, shown in a side view for ease of description.

Referring to FIG. 1, in a preferred method of creating finished perforations in the wall 10 of an oil or gas well, which is made up of steel casing 12, cement 13 and underlying rock 14, a perforating gun 15 is lowered into proximity of a portion of wall 10, to be treated. Perforating gun 15 includes a charge tube 16, which supports a number of shaped charges 18, containers 20 of propellant 38 (FIG. 7) and a detonating cord 22, all encased in a fluid-impermeable sealed steel carrier 24.

Figure 2:
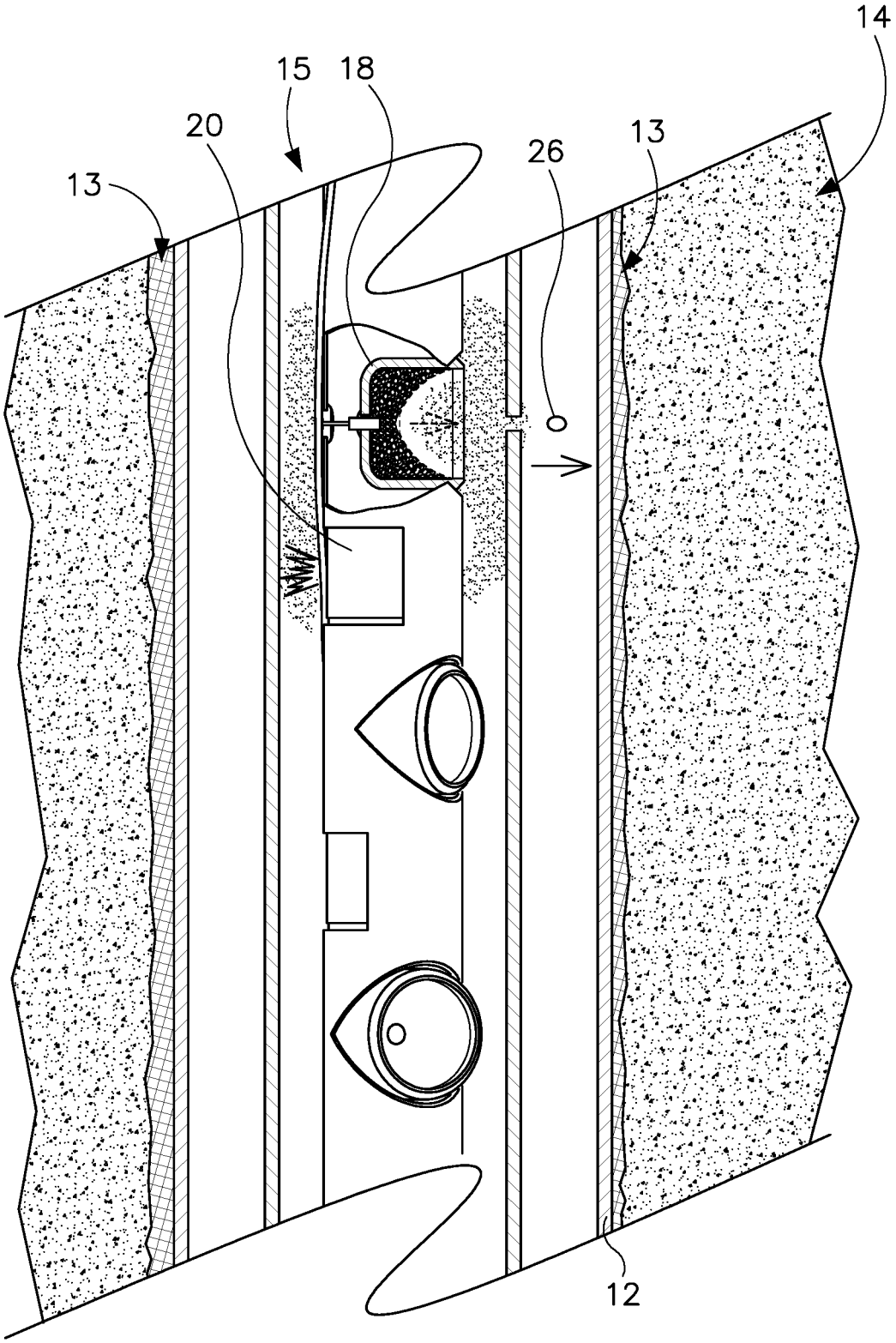
FIG. 2 shows the environment and device of FIG. 1, during detonation of the device.
Figure 3:
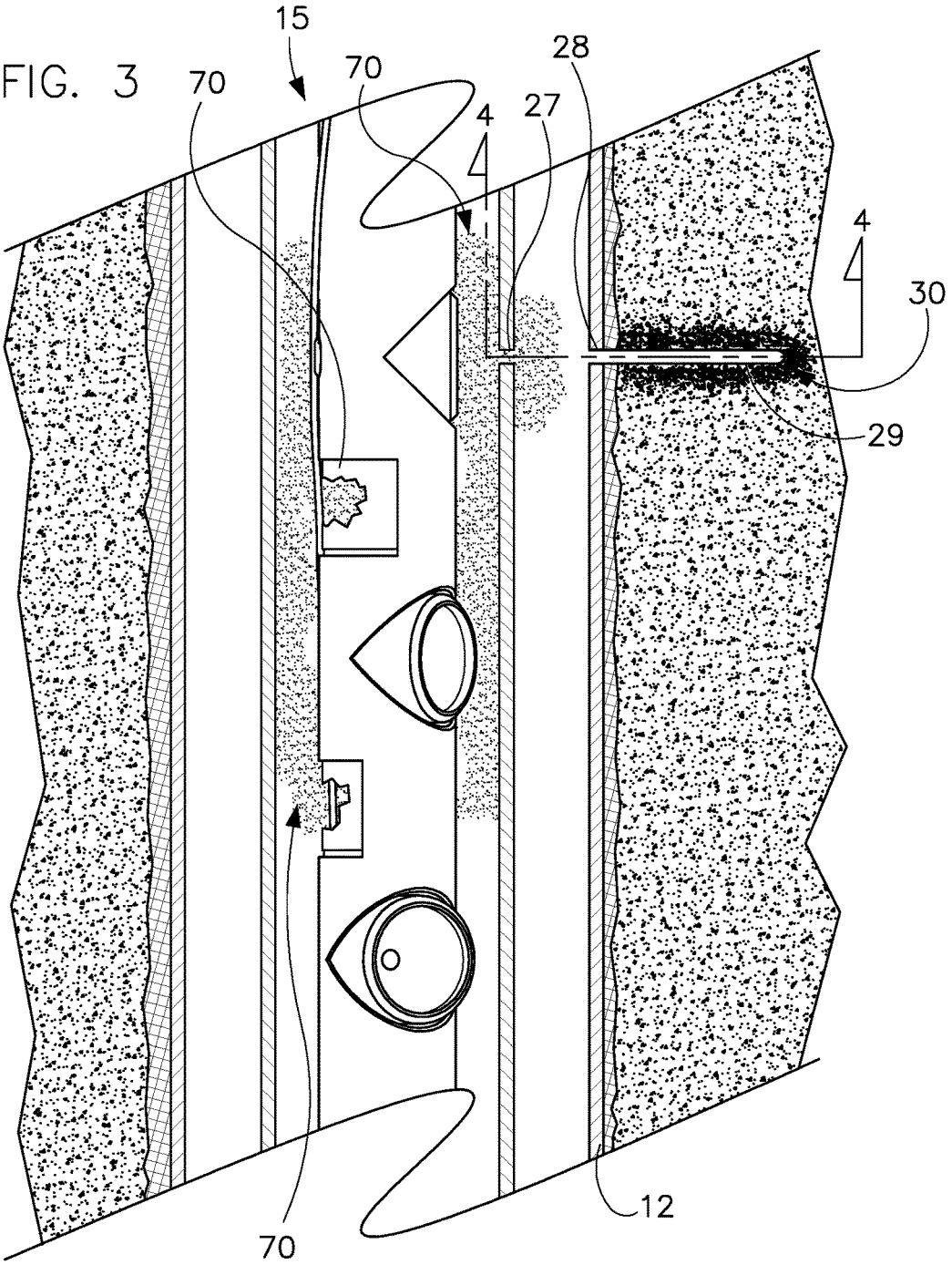
FIG. 3 shows the environment and device of FIG. 1, at a further stage of deployment, after a perforation in the well wall has been created.
Figure 4:
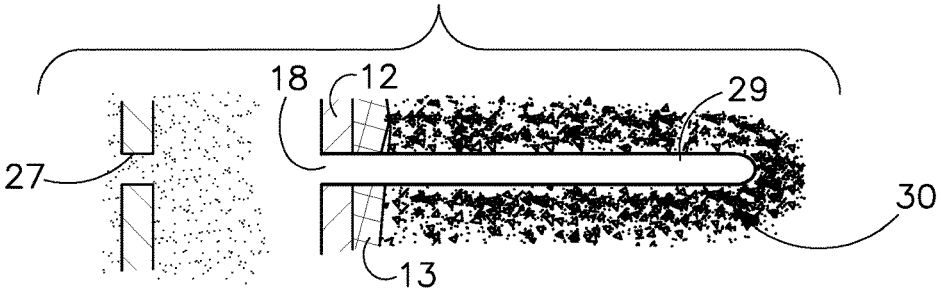
FIG. 4 is an expanded sectional detail view of the well wall perforation of FIG. 3, taken along line 4-4 of FIG. 3.
Figure 5:
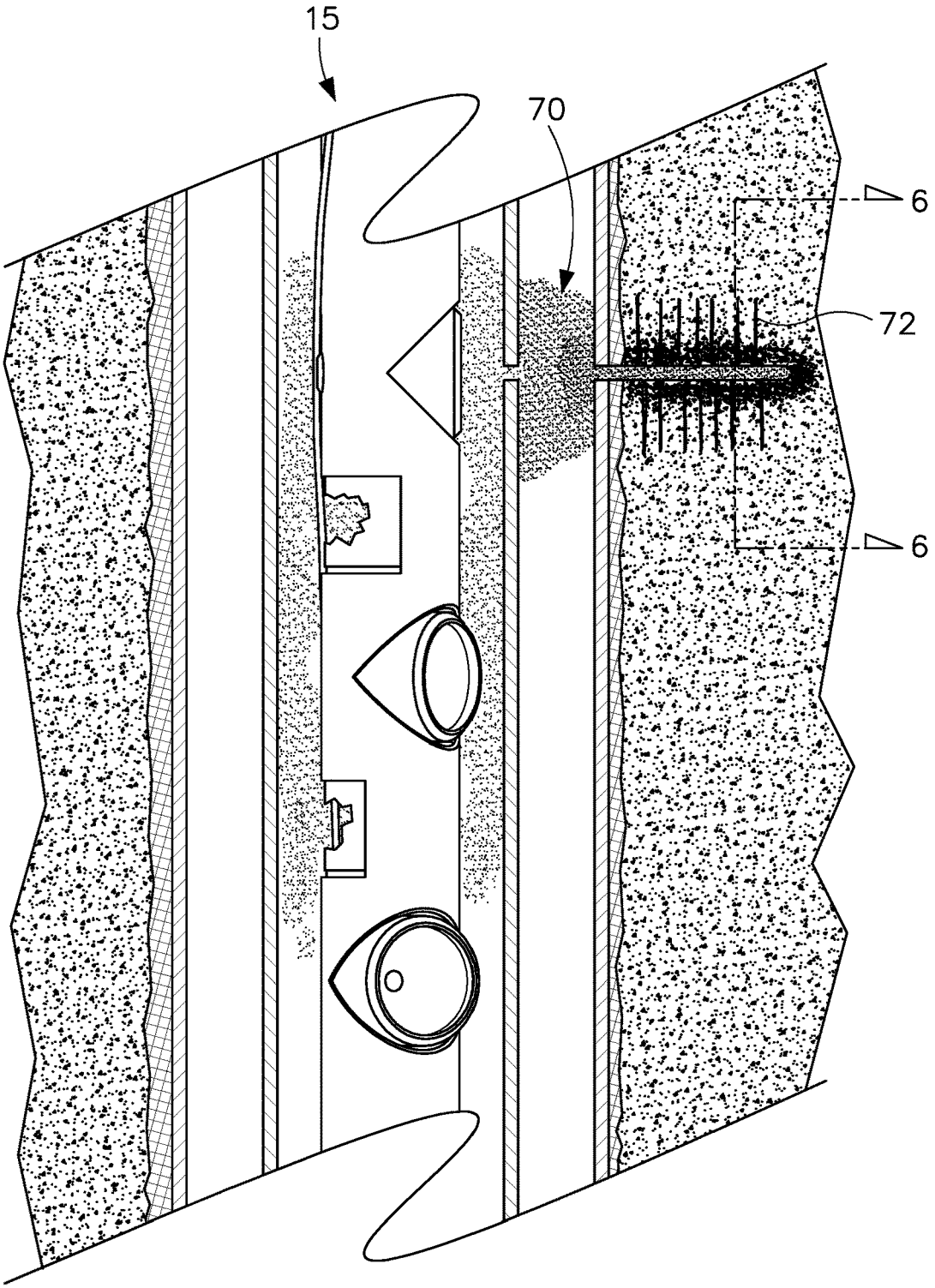
FIG. 5 shows the environment and device of FIG. 1, at a final stage of deployment, showing the finished perforation.
Figure 6:
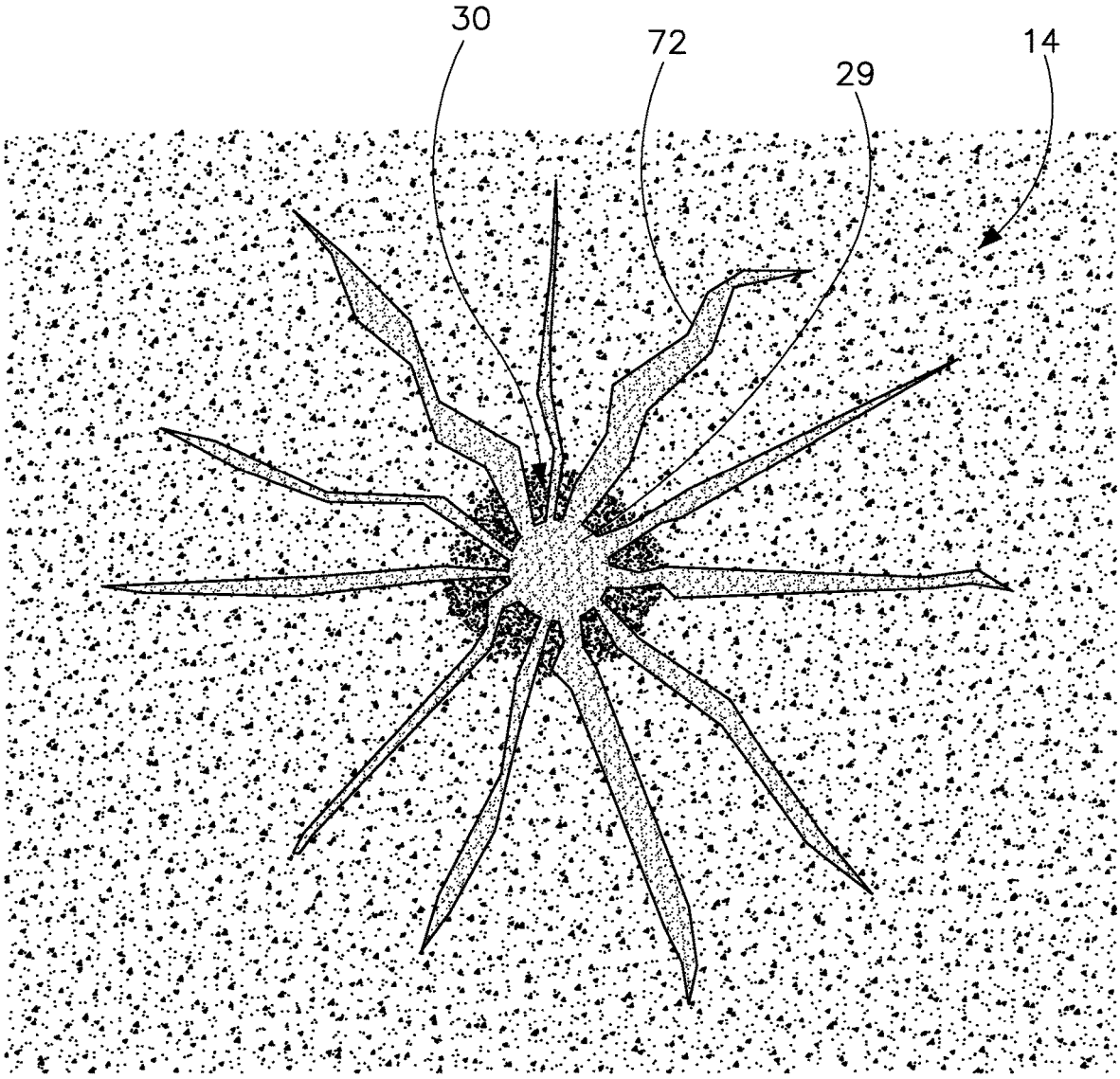
FIG. 6 is an expanded sectional detail view of the finished well wall perforation of FIG. 5, taken along line 6-6 of FIG. 5.

Referring to FIGS. 2 and 3, the detonating cord 22 is ignited, causing the shaped charges 18 to expel particles of metal 26 (FIG. 2—shown as an ellipse for ease of presentation) at a high velocity, within ten microseconds. Travelling at approximately 30 mach, the metal particles 26 penetrate through steel carrier 24, creating a carrier perforation 27 (FIG. 3) and into the wall 10, creating a perforation 28 (FIG. 3) through the steel casing 12, and a further perforation 29 (FIG. 3) in the rock 14, thereby facilitating the flow of hydrocarbons into the well.

The movement of the metal particles 26 into the rock creates a perforation 29, having walls 30, which have been seared and made more dense by rock 14 that has been pushed to the side or pushed toward the back of the perforation 29. Consequently, the perforation does not facilitate the flow of oil as much as might be possible. The containers 20 of propellant 38 combust over a period between 10 and 100 milliseconds, far more slowly than the action of the shaped charges 18.

In one preferred embodiment, the rate of combustion 56 of the propellant 38 increases with greater pressure, causing the combustion rate to increase at a greater than linear rate 48 as some propellant 38 combusts and the gas thereby released creates a higher pressure; however, at least one additional piece 39 of propellant 38 may not combust at an increasing rate after being ignited. Referring to FIGS. 5, 6, 7 and 8, in a few milliseconds, the combustion has spread over the surface areas of the pieces 39 of propellant 38 (FIG. 7), including the interior surface areas, created by a set of seven through-holes 40 in each piece 39 of propellant 38.

As the through-holes 40 grow in diameter, due to the combustion, the surface area of each through-hole grows, just as the outer diameter of the piece 39 of propellant 38 is reduced over time. In one preferred embodiment, the pieces 39 of propellant 38 are packed together in groups, with each group including seven pieces 39 of propellant 38, and being interposed between two shaped charges.

Referring to FIG. 8, as the propellant collectively combusts, the combustion rate 48 of propellant 38 reaches a maximum 50 (FIG. 8), directly before the fuel is exhausted, resulting in a high maximum combustion rate 50, followed by a rapid plunge 58 to zero 60. In one preferred embodiment, the rapid decline 58 takes less than one-sixth of the blast time duration. In another preferred embodiment, the rapid decline 58 takes less than one-tenth of the blast time duration. Not only does the combustion rate increase due to through-holes 40, but also because propellant 38 combusts more rapidly under higher pressure.

As the combustion progresses, a gas 70 is produced, which increases the pressure inside carrier 24 (and very quickly, outside of carrier 24, as well). This increased pressure also causes propellant 38 to combust more rapidly, leading to the nonlinear combustion rate curve 48. In a preferred embodiment, the period during which the combustion rate plunges from the maximum 50 to zero 60 (the combustion cessation period), takes less than one-tenth of the total time period of combustion 56. For each piece 39 of propellant 38 the combustion cessation period is less than one-thirtieth of the period of combustion 56 (for the same piece 39 of propellant 38).

The hot gas 70, that is the product of the propellant combustion is pushed rapidly and forcefully out of the tubing carrier perforations 27 with increasing speed that is proportional to the increasing pressure caused by the gas blast, and into well wall perforations 28 and 29, which are still fairly well aligned with carrier perforation 27, as the relatively massive perforating gun 16 accelerates and moves relatively slowly. In one preferred method, the pressure created by gas 70 increases until a maximum is reached before declining rapidly. Both the speed and the pressure of the gas 70 act to break apart the rock 14, and create a star pattern of fissures 72 emanating radially from perforation 28, thereby facilitating the flow of oil and gas into the well.

The through-holes 40 of propellant 38 result in a higher maximum combustion rate and a corresponding higher pressure at perforation 29, than would be otherwise the case. Surprisingly, because of the through-holes 40, the maximum pressure applied to the perforations 29 is high enough to be effective, even though large portions of steel carrier 24 are taken up by shaped charges 18, and thereby not available for stowage of propellant 38.

The propellant 38 includes its own oxidizer, and so does not need any external source of oxygen to combust. Further, propellant 38 may be either single-based (nitrocellulose), double-based (nitrocellulose and nitroglycerin), or triple-based (nitrocellulose, nitroglycerin, and nitroguanadine). These propellants may be available from BAE Systems, in Radford, Va.

While a number of exemplary aspects and embodiments have been discussed above, those possessed of skill in the art will recognize certain modifications, permutations, additions and sub-combinations thereof. For example, one or more pieces of propellant that do not include through-holes could be included and combust at a decreasing rate, or that include a single through-hole and combust at a steady rate, could be included. It is therefore intended that the following appended claims and claims hereafter introduced are interpreted to include all such modifications, permutations, additions and subcombinations as are within their true spirit and scope.

What is claimed is:

1. A method of creating and finishing perforations in a hydrocarbon well, the method comprising:

igniting one or more shaped charges to shoot a high velocity jet of metal particles into a wall of the hydrocarbon well and thereby creating a perforation in the wall;

igniting one or more pieces of propellant housed within a container axially spaced from the one or more shaped charges and thereby generating a gas blast that is pushed into the perforation for a blast time duration, wherein a rate of combustion of the one or more pieces of propellant increases at a greater than linear rate; and creating an increasing pressure at the perforation with the gas blast until a maximum pressure is reached, the pressure of the gas then undergoing a period of rapid decline to a level of less than 50% of the maximum pressure, wherein each piece of propellant includes a plurality of through-holes defined in a hexagonal arrangement with one of the plurality of through-holes arranged at a center of the hexagonal arrangement.

2. The method of claim 1, wherein the period of rapid decline takes less than one-sixth of the blast time duration.

3. The method of claim 1, wherein the gas blast flows at an increasing speed, as the pressure increases.

4. The method of claim 1, wherein the one or more pieces of propellant are packed together in a group interposed between two shaped charges of a plurality of shaped charges.

5. The method of claim 4, wherein the plurality of through-holes causes the surface area of the at least one of the pieces of propellant to increase during the combustion.

6. The method of claim 5, wherein the plurality of through-holes comprises seven through-holes.

7. The method of claim 1, wherein the propellant combusts over a period of greater than 10 milliseconds and less than 100 milliseconds.

8. The method of claim 1, wherein the assembly comprises another piece of propellant that does not combust at the greater than linear rate after being ignited.

9. A perforating gun, comprising:

a charge tube;

one or more shaped charges supported in the charge tube;

one or more containers supported in the charge tube and axially offset from the one or more shaped charges, each container housing one or more pieces of propellant, wherein each piece of propellant includes a plurality of through-holes defined in a hexagonal arrangement with one of the plurality of through-holes arranged at a center of the hexagonal arrangement;

a detonating cord extending to each shaped charge and each container to simultaneously ignite the one or more shaped charges and the one or more pieces of propellant in each container, wherein a rate of combustion of each piece of propellant increases at a greater than linear rate and a surface area of each piece of propellant increases during combustion until consumed by the combustion.

10. The perforating gun of claim 9, further comprising a sealed carrier that receives the charge tube.

11. The perforating gun of claim 9, wherein each container comprises:

a lower cap that receives the one or more pieces of propellant; and an upper cap sized to mate with the lower cap and thereby secure the one or more pieces of propellant within the lower cap.

12. The perforating gun of claim 11, wherein at least one of the one or more pieces of propellant is cylindrical and exhibits a circular cross-sectional shape.

13. The perforating gun of claim 11, wherein one or more gaps are defined between the one or more pieces of propellant.

14. The perforating gun of claim 9, further comprising an additional piece of propellant housed within at least one of the one or more containers, wherein a surface area of the additional piece of propellant decreases during combustion until consumed by the combustion.

15. The perforating gun of claim 9, wherein the one or more pieces of propellant are arranged in the lower cap in a hexagonal arrangement with one of the one or more pieces of propellant arranged at a center of the hexagonal arrangement.

16. A propellant container for a perforating gun, comprising:

a lower cap that receives one or more pieces of propellant, wherein each piece of propellant provides a plurality of through-holes defined in a hexagonal arrangement with one of the plurality of through-holes arranged at a center of the hexagonal arrangement; and an upper cap sized to mate with the lower cap and thereby secure the one or more pieces of propellant within the lower cap, wherein a rate of combustion of each piece of propellant increases at a greater than linear rate and a surface area of each piece of propellant increases during combustion until consumed by the combustion.

17. The propellant container of claim 16, wherein the one or more pieces of propellant are packed within the lower cap in a group of seven pieces of propellant.

18. The propellant container of claim 16, wherein the one or more pieces of propellant are cylindrical and exhibit a circular cross-sectional shape.

19. The propellant container of claim 16, wherein the plurality of through-holes are defined longitudinally through each piece of propellant.

20. The propellant container of claim 16, wherein the one or more pieces of propellant are arranged in the lower cap in a hexagonal arrangement with one of the one or more pieces of propellant arranged at a center of the hexagonal arrangement.

* * * * *